US008684356B2

(12) United States Patent
Fukusaka et al.

(10) Patent No.: US 8,684,356 B2
(45) Date of Patent: Apr. 1, 2014

(54) SHEET FEEDING APPARATUS AND IMAGE FORMING APPARATUS

(75) Inventors: Tetsuro Fukusaka, Abiko (JP); Yuzo Matsumoto, Abiko (JP); Yoshitaka Yamazaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/045,185

(22) Filed: Mar. 10, 2011

(65) Prior Publication Data

US 2011/0221116 A1 Sep. 15, 2011

(30) Foreign Application Priority Data

Mar. 12, 2010 (JP) ..... 2010-055679

(51) Int. Cl.
*B65H 7/02* (2006.01)

(52) U.S. Cl.
USPC ..... 271/265.03; 271/265.02; 271/265.01

(58) Field of Classification Search
USPC ..... 271/265.01, 265.02, 265.03, 265.04
See application file for complete search history.

(56) References Cited

U.S. PATENT DOCUMENTS

| | | | | |
|---|---|---|---|---|
| 6,053,495 | A | 4/2000 | Hara | |
| 7,331,578 | B2 * | 2/2008 | Sano et al. | 271/262 |
| 7,347,419 | B2 * | 3/2008 | Sano et al. | 271/265.04 |
| 7,445,209 | B2 * | 11/2008 | Sano et al. | 271/263 |
| 7,552,924 | B2 * | 6/2009 | Sano et al. | 271/263 |
| 7,654,521 | B2 * | 2/2010 | Simonis et al. | 271/262 |
| 2011/0278791 | A1 * | 11/2011 | Fujii et al. | 271/265.04 |

FOREIGN PATENT DOCUMENTS

| | | | |
|---|---|---|---|
| EP | 888991 | A2 | 1/1999 |
| EP | 888991 | A3 | 6/1999 |
| EP | 888991 | B1 | 10/2003 |
| JP | 11-20988 | A | 1/1999 |
| JP | 11-020988 | A | 1/1999 |
| JP | 2000-95390 | A | 4/2000 |
| JP | 2000-095390 | A | 4/2000 |
| JP | 3393175 | B2 | 4/2003 |
| JP | 2005-162423 | A | 6/2005 |
| JP | 2006-312527 | A | 11/2006 |
| JP | 3890766 | B2 | 3/2007 |
| JP | 4353778 | B2 | 10/2009 |
| JP | 2009-292574 | A | 12/2009 |

* cited by examiner

*Primary Examiner* — Kaitlin Joerger
(74) *Attorney, Agent, or Firm* — Canon USA, Inc., IP Division

(57) ABSTRACT

Provided are a high-quality sheet feeding apparatus which can detect multifeeding of sheets in a wide range of the sheet conveying direction and realize a stable conveying state, and an image forming apparatus therewith. A CPU controls a multifeeding detection sensor to detect multifeeding of sheets at a plurality of transmission points P1 to P5 of the multifeeding detection sensor. This CPU sets a plurality of transmission points across the front end and rear end of a sheet moving in the sheet conveying direction, based on size information of the sheet read from a storage portion and the timing of detection passing of the sheet in a horizontal path first sensor. This enables detection of multifeeding across the front end and rear end of a preceding sheet in the sheet conveying direction, and also enables detection of unseparated multifeeding that a subsequent sheet follows overlapping the preceding sheet.

7 Claims, 11 Drawing Sheets

SHEET CONVEYING DIRECTION

SHEET FEEDING APPARATUS AND IMAGE FORMING APPARATUS

BACKGROUND OF THE INVENTION

1. Field of the Invention

The present invention relates to a sheet feeding apparatus which feeds sheets from sheet accommodating portions such as storage units, and an image forming apparatus such as a printer or copying machine having this sheet feeding apparatus.

2. Description of the Related Art

Conventionally, a sheet supplying apparatus which detects overlapping of sheets using detection data from an ultrasonic sensor for one measurement area selected from a plurality of measurement areas based on information acquired from a sheet length recognizing portion to detect multifeeding of sheets has been proposed for image forming apparatuses such as copying machines (see Japanese Patent Laid-Open No. 2005-162423).

Further, to prevent detection error due to the type of sheets (type of paper), temperature and humidity, there has been proposed a feeding apparatus which temporarily stops a sheet which is being conveyed, emits from an ultrasonic wave emitting portion an ultrasonic wave for detecting multifeeding, and detects multifeeding using an output of a ultrasonic receiving portion which receives the emitted ultrasonic wave (see Japanese Patent Laid-Open No. 2006-312527).

According to conventional multifeeding detecting methods, overlapping of sheets is detected based on detection data of one measurement area selected from a plurality of measurement areas, so that, when sheets overlap in the one selected measurement area, it is possible to detect multifeeding of sheets. However, in case of occurrence of unseparated multifeeding that a subsequent sheet overlaps a preceding sheet in an unselected area, there arises a problem that unseparated multifeeding cannot be detected as multifeeding.

Further, with the configuration of detecting multifeeding by temporarily stopping sheets which are being conveyed, it is possible to stably detect the multifeeding state in a portion where the ultrasonic wave for detecting multifeeding of temporarily stopped sheets transmits. However, when sheets are multifed in the other portions, it is not possible to determine multifeeding.

SUMMARY OF THE INVENTION

The present invention provides a high-quality sheet feeding apparatus and an image forming apparatus having this sheet feeding apparatus which can detect multifeeding of sheets in almost all areas in the sheet conveying direction and which can provide a stable conveying state.

According to the present invention, the sheet feeding apparatus which has: a sheet accommodating portion which accommodates a sheet; a storage portion which stores information of a sheet conveying direction size of the sheet accommodated in the sheet accommodating portion; a sheet conveying path which guides the sheet sent out from the sheet accommodating portion in a sheet conveying direction; a passing detecting portion which detects passing of the sheet sent out from the sheet accommodating portion and guided on the sheet conveying path; a multifeeding detecting portion which detects multifeeding of the sheet having passed the passing detecting portion; a controlling portion which controls the multifeeding detecting portion to cause the multifeeding detecting portion to detect multifeeding of the sheet at a plurality of detection points, wherein the controlling portion sets a plurality of detection points across a front end and a rear end of the sheet moving in the sheet conveying direction, based on the size information read from the storage portion and a timing of detecting passing of the sheet in the passing detecting portion.

According to the present invention, setting a plurality of detection points of a multifeeding detecting portion enables detection of multifeeding across the front end and rear end of a preceding sheet in the sheet conveying direction, and enables reliable detection of unseparated multifeeding that a subsequent sheet follows overlapping a preceding sheet. Accordingly, it is possible to provide a stable conveying state and realize a high-quality sheet feeding apparatus.

Further features of the present invention will become apparent from the following description of exemplary embodiments with reference to the attached drawings.

DESCRIPTION OF THE EMBODIMENTS

Embodiments of the present invention will be described in detail using drawings. First, a schematic configuration of an image forming apparatus having a sheet feeding apparatus according to the present invention will be described with reference to FIG. 1, FIG. 2, FIGS. 9A and 9B and FIGS. 10A and 10B.

Figure 1:
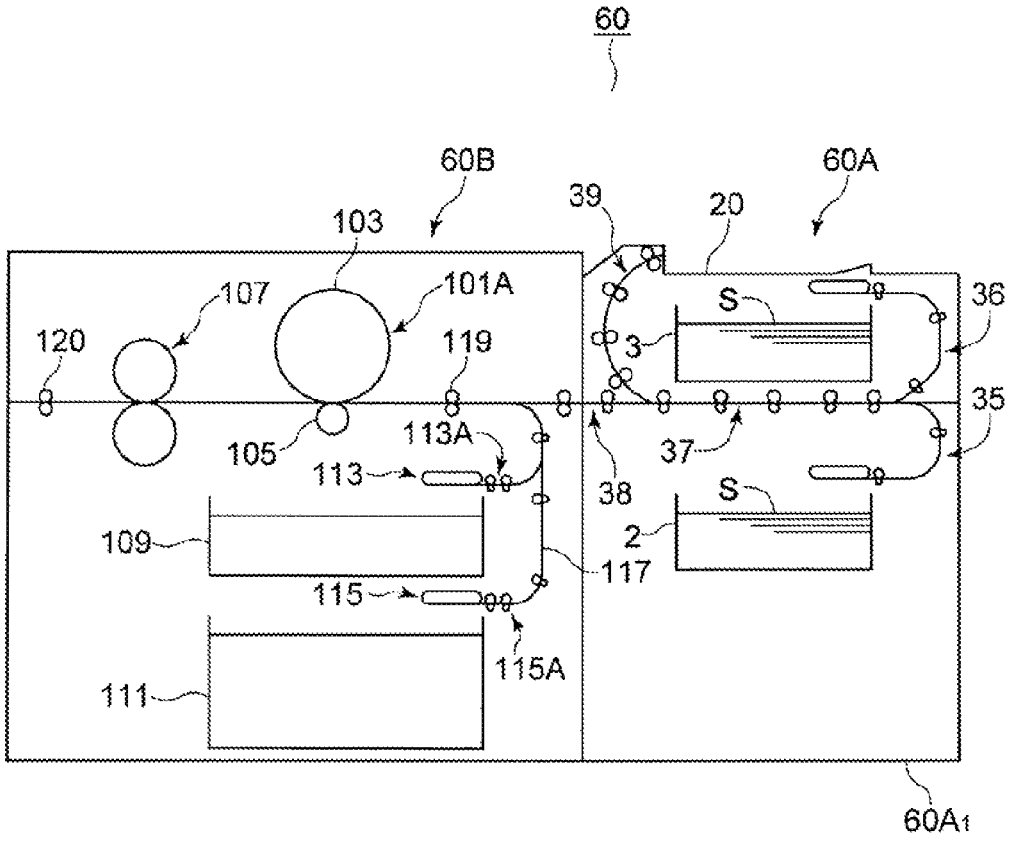
FIG. 1 is a schematic sectional view illustrating an image forming apparatus having a sheet feeding unit as a sheet feeding apparatus according to the present invention.

As illustrated in FIG. 1, an image forming apparatus 60 has a sheet feeding unit 60A which is the sheet feeding apparatus, and an image forming unit 60B.

Figure 2:
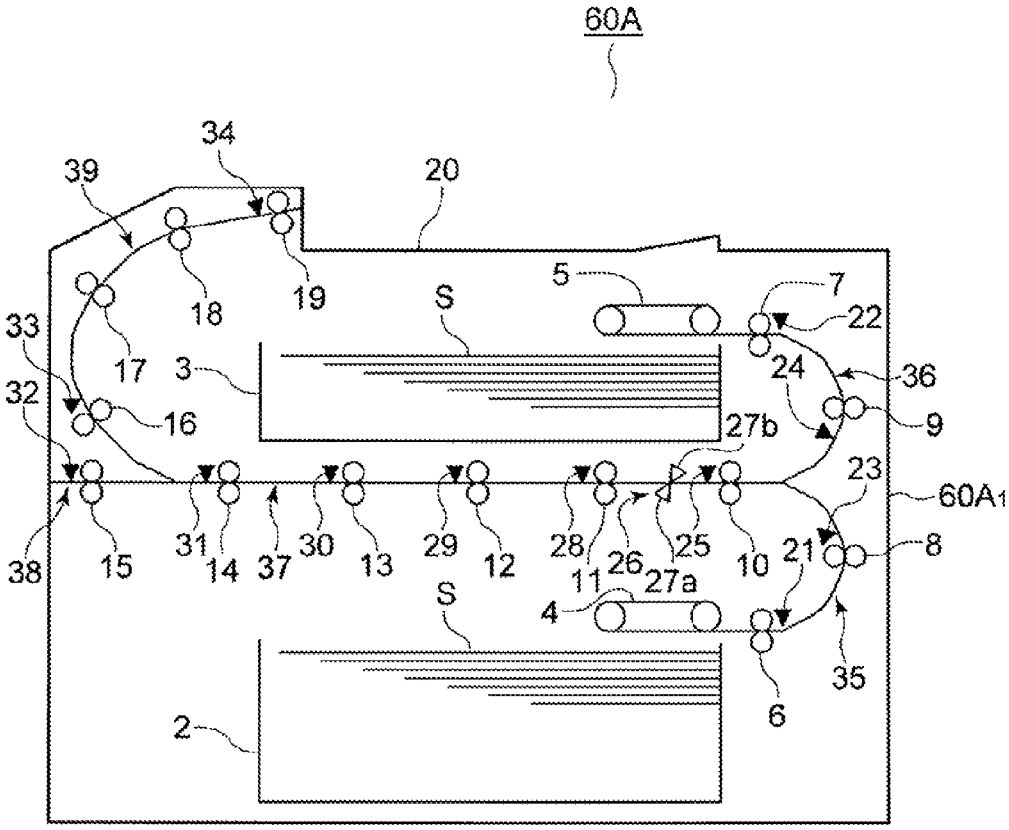
FIG. 2 is a schematic sectional view illustrating a sheet feeding unit according to the present invention.

As illustrated in FIGS. 1 and 2, the sheet feeding unit (sheet feeding apparatus) 60A has storage units 2 and 3, attracting convey belts 4 and 5, a lower vertical path 35, an upper vertical path 36, a horizontal path 37, a buffer path 38 and an escape path 39 inside an apparatus body 60A1.

Figure 9A:
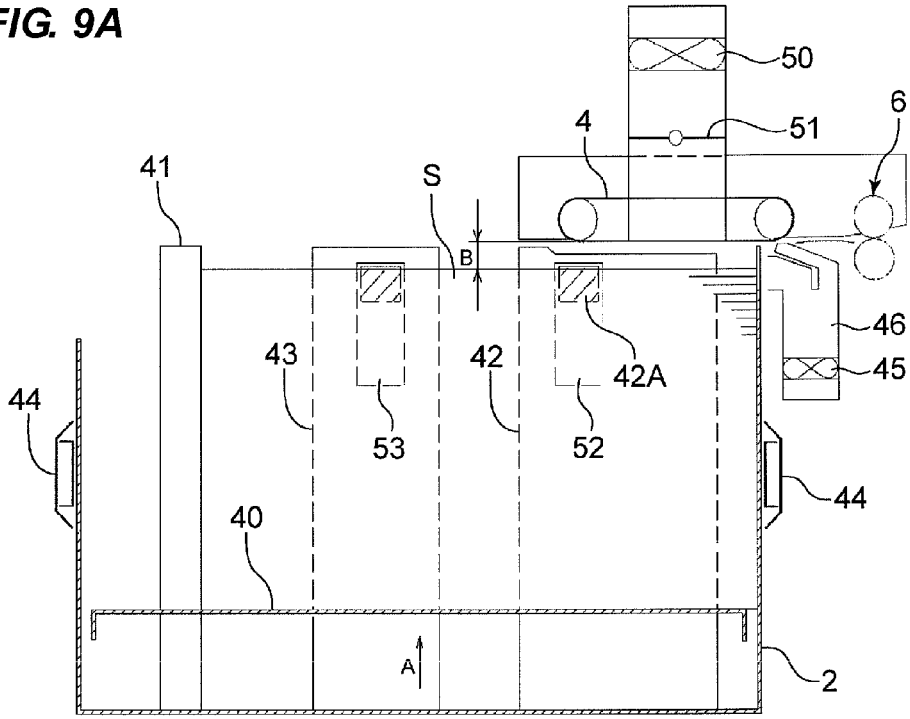
FIG. 9A is a schematic sectional view illustrating an air feeding portion of a sheet feeding unit according to the present invention.

As illustrated in FIGS. 9A and B, the storage unit 2 which is a sheet accommodating portion has a tray 40 on which a plurality of sheets S are stacked, and a rear end restricting plate 41 and lateral end restricting plates 42 and 43. The rear end restricting plate 41 restricts the upstream side (rear end side) of the sheet conveying direction of the sheets S (right in FIG. 9). The lateral side restricting plates 42 and 43 restrict the width direction (horizontal direction) orthogonal to the sheet conveying direction of the sheets S. The storage unit 2 is arranged to be drawable along slide rails 44 from the apparatus body 60A1. With this configuration, when the user draws the storage unit 2 to set the sheets S (hereinafter, also "sheet bundle S") thereon and stores the sheets S in a predetermined position, the tray 40 starts rising in the direction of an arrow A in FIG. 9A by an unillustrated driving unit. Then, the tray 40 stops at a position where the distance to the attracting convey belt 4 is B, and waits for a feed signal.

Figure 9B:
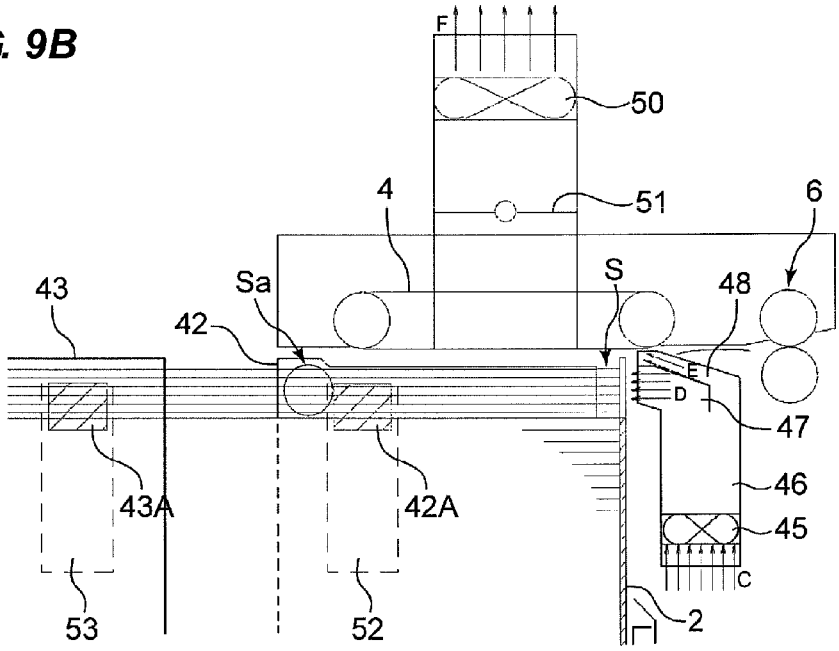
FIG. 9B is a schematic sectional view illustrating an air feeding operation of a sheet feeding unit.

When detecting a feed signal in FIG. 9A, a loosening/separating air supplying portion 45 operates and suctions air in the direction of an arrow C in FIG. 9B. This air is blown to the sheet bundle S from the directions of arrows D and E in FIG. 9B by a loosening nozzle 47 and a separating nozzle 48 through a separating duct 46. Then, some sheets (Sa) of the sheet bundle S are blown up as illustrated in FIG. 9B. Then, the attracting fan 50 is operated, and blows out air in the direction of an arrow F in FIG. 9B. At this time, an attracting shutter 51 is still closed. Further, auxiliary separating fans 52 and 53 are attached to the lateral end restricting plates 42 and 43, respectively, and the auxiliary separating fans 52 and 53 blow air to the sheet bundle S from openings 42A and 43A.

Figure 10A:
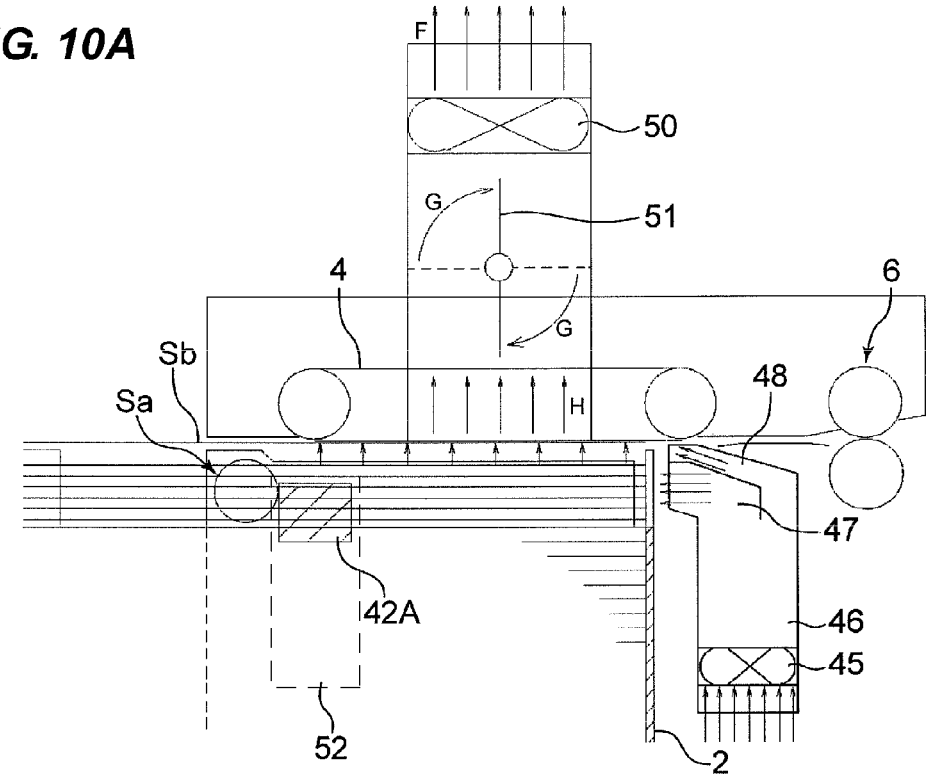
FIG. 10A is a schematic sectional view illustrating another state of the air feeding operation of the sheet feeding unit according to the present invention.

Further, when the sheets Sa are blown up stably after a predetermined time passes since the feed signal is detected in FIG. 9B, the attracting shutter 51 is rotated in the direction of an arrow G in FIG. 10A. Then, the suctioning force is generated in the direction of an arrow H in FIG. 10A from unillustrated suctioning holes made in the attracting convey belt 4. As a result, the uppermost sheet Sb is attracted.

Figure 10B:
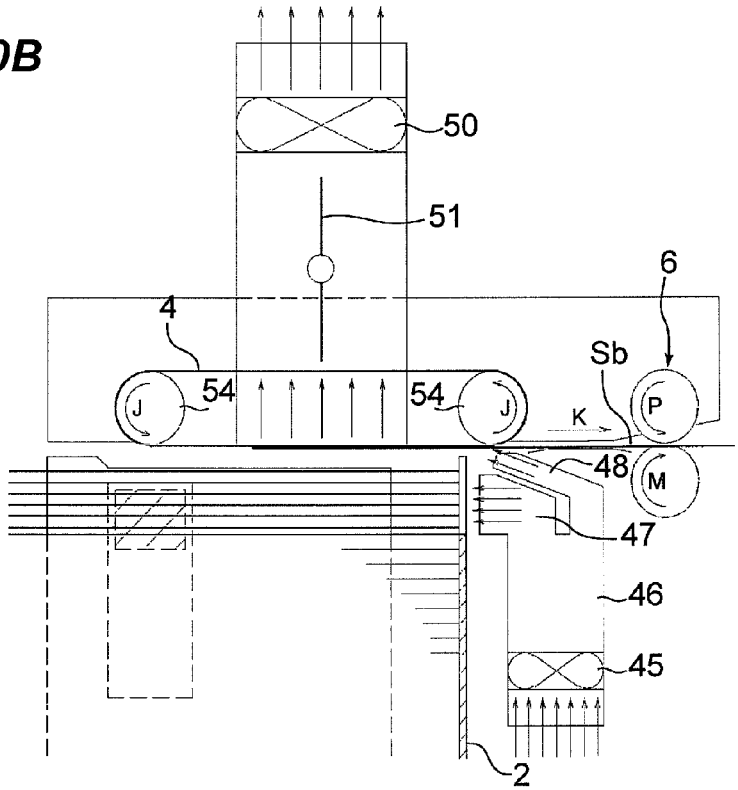
FIG. 10B is a schematic sectional view illustrating another state of the air feeding operation of the sheet feeding unit.

Then, in FIG. 10B, belt drive rollers 54 and 54 supporting the attracting convey belt 4 at both ends are rotated in the direction of an arrow J in FIG. 10B, so that the sheet Sb is conveyed in the direction of an arrow K in FIG. 10B. Then, a pair of pull-out rollers 6 finally rotate in the directions of arrows M and P in FIG. 10B, so that the sheet Sb is sent to a sheet conveying path.

Further, in FIG. 2, the sheet pulled out from the storage unit 2 and sent to the sheet conveying path by the pair of pull-out rollers 6 is sent to a pair of lower vertical path rollers 8 arranged in the downstream of the lower vertical path 35. Furthermore, the sheet is sent to a pair of horizontal path rollers 10 in the downstream of the merging point to the upper vertical path 36 from the storage unit 3 which is a sheet accommodating portion.

In the direct downstream of the pair of pull-out rollers 6, a pull-out sensor 21 which is formed by a reflective sensor is arranged to monitor whether or not a sheet is held in this position and a sheet arrival time is not delayed. In the direct downstream of the pair of lower vertical path rollers 8, a lower vertical path sensor 23 which is formed with a reflective sensor is arranged to monitor whether or not a sheet is held in this position and a sheet arrival time is not delayed.

In the downstream of the pair of horizontal path rollers 10, a horizontal path 37 is provided. In the downstream of the pair of horizontal path rollers 10, a multifeeding detection sensor 26 is arranged to have its components opposite each other across the horizontal path 37. In addition, the lower vertical path 35 and the horizontal path 37 connecting to the upper vertical path 36 form a sheet guiding sheet conveying path which moves in the sheet conveying direction the sheets S sent out from the storage unit 2 or 3 of the sheet accommodating portion.

The multifeeding detection sensor 26 has an emitting element 27*a* and a receiving element 27*b*, and forms a multifeeding detecting portion which detects multifeeding of the sheets S having passed a first horizontal path sensor 25 of a passing detecting portion. The multifeeding detection sensor 26 detects whether or not the sheets conveyed to the horizontal path 37 are multifed. In addition, although the multifeeding detection sensor 26 includes the emitting element 27*a* and receiving element 27*b* which are ultrasonic sensors (wave transmitting element and wave receiving element) according to the present embodiment, the multifeeding detection sensor 26 is not restrictive and may include other types of sensors.

On the horizontal path 37, pairs of horizontal path rollers 11, 12 and 13, a pair of buffer path rollers 14 and a pair of buffer discharge rollers 15 are arranged in order from the pair of horizontal path rollers 10 side. A sheet is conveyed by a pair of horizontal path rollers 10 is conveyed on the horizontal path 37 through pairs of horizontal path rollers 11, 12 and 13, and is sent to a pair of buffer path rollers 14.

In the direct downstream of the pair of horizontal path rollers 10 on the horizontal path 37, the first horizontal path sensor 25 which is a monitoring portion to monitor (detect) passing of sheets conveyed to the horizontal path 37 through the lower vertical path 35 or upper vertical path 36 from the storage unit 2 or 3. This first horizontal path sensor 25 forms a passing detecting portion which detects passing of the sheets S sent out from storage unit 2 or 3 of the sheet accommodating portion and guided on the sheet conveying path. Further, in the direct downstream of the pair of horizontal path rollers 11, a horizontal path second sensor 28 is arranged.

In the direct downstream of the pair of horizontal path rollers 12, a horizontal path third sensor 29 is arranged and, in the direct downstream of the pair of horizontal path rollers 13, a horizontal path fourth sensor 30 is arranged. Further, in the direct downstream of the pair of buffer path rollers 14, a buffer path sensor 31 is arranged and, in the direct downstream of a pair of buffer discharge rollers 15, a buffer discharge sensor 32 is arranged. All of these first horizontal path sensor 25, second horizontal path sensor 28, third horizontal path sensor 29, fourth horizontal path sensor 30, buffer path sensor 31 and buffer discharge sensor 32 comprise reflective sensors, respectively.

The first horizontal path sensor 25, second horizontal path sensor 28, third horizontal path sensor 29 and fourth horizontal path sensor 30 monitor whether or not sheets are held in the respective positions and the sheet arrival time is not delayed, and serve as the reference positions to temporarily stop a sheet.

When it is decided according to an output signal of the multifeeding detection sensor 26 (27*a* and 27*b*) that the sheet conveyed to the pair of buffer path rollers 14 is not multifed, the sheet is conveyed to the pair of buffer discharge roller 15 of the buffer path 38, and is sent to the image forming unit 60B.

The buffer path 38 is configured to increase or decrease the sheet conveying velocity according to the image forming unit 60B. When it is decided according to the output signal of the multifeeding detection sensor 26 that the sheets are multifed, the sheet conveying route is switched to an escape path 39 by operating a solenoid 209 which is described later.

On the escape path 39, pairs of escape path rollers 16, 17 and 18 and a pair of escape discharge rollers 19 are arranged in order from a branching point from the horizontal path 37. In the direct downstream of the pair of escape path rollers 16, an escape path sensor 33 is arranged and, in the direct upstream of the pair of escape discharge rollers 19, an escape discharge sensor 34 is arranged. Both of these escape path sensor 33 and escape discharge sensor 34 comprise reflective sensors respectively, and monitor whether or not sheets are held in respective positions and the sheet arrival time is not delayed.

After the sheet conveying route is switched from the horizontal path 37 to the escape path 39, the multifed sheets are discharged to an escape tray 20 through the pairs of escape path rollers 16, 17 and 18 and the pair of escape discharge rollers 19.

In FIG. 2, the storage unit 3 is arranged in the upper stage, and the attracting convey belt 5 is used to feed sheets from the storage 3 of the upper stage. A pair of pull-out rollers 7 pull out sheets from the storage unit 3 when the sheets are fed from the storage unit 3 of the upper stage, the pair of upper vertical path rollers 9 are arranged in the downstream of the upper vertical path 36 and the pull-out sensor 22 is provided in the upper stage and the upper vertical path sensor 24 is provided. The operation of feeding sheets from the storage unit 3 of the upper stage is the same as the above-described operation of feeding sheets from the storage unit 2 of the lower stage and therefore will not be described.

By contrast with this, as illustrated in FIG. 1, the image forming unit 60B has an electrophotographic system image forming portion 101A having a photosensitive drum 103. Further, the image forming unit 60B has sheet decks 109 and 111, and sheet feeding apparatuses 113A and 115A having sheet feeding mechanisms 113 and 115 which feed sheets accommodated in the sheet decks 109 and 111. The sheet conveying path to a pair of registration rollers 119 of the image forming unit 60B is connected directly with the buffer path 38 of the sheet feeding unit 60A. The pair of registration rollers 119 are arranged in the upstream side of the image forming portion 101A to correct skew feeding of sheets and align the positions of a toner image and a sheet on the photosensitive drum 103.

Then, when an image forming operation starts in the image forming unit 60B having this configuration, an unillustrated exposing portion and a developing portion in the image forming portion 101A form a toner image on the photosensitive drum 103.

The sheets accommodated in the sheet decks 109 and 111 are conveyed to the pair of registration rollers 119 by the sheet feeding mechanisms 113 and 115 through the sheet conveying path 117. Further, sheets sent by the pair of buffer discharge rollers 15 from the buffer path 38 of the sheet feeding unit 60A are also conveyed to the pair of registration rollers 119. Then, after skew feeding of sheets is corrected by the pair of registration rollers 119, the sheets are conveyed between the photosensitive drum 103 and transfer roller 105 at predetermined timings.

By this means, a toner image formed on the photosensitive drum 103 is transferred between the photosensitive drum 103 and transfer roller 105 to the sheet, and a pair of fixing rollers 107 heat and pressure the sheet, so that the toner image is fixed to the sheet. The sheet to which the toner image is fixed in this way is discharged by the discharge roller 120 from the image forming unit 60B. In addition, a delivery unit (not illustrated) which delivers sheets from the sheet feeding unit 60A to the image forming unit 60B may be arranged between the sheet feeding unit 60A and image forming unit 60B.

First Embodiment

Figure 3:
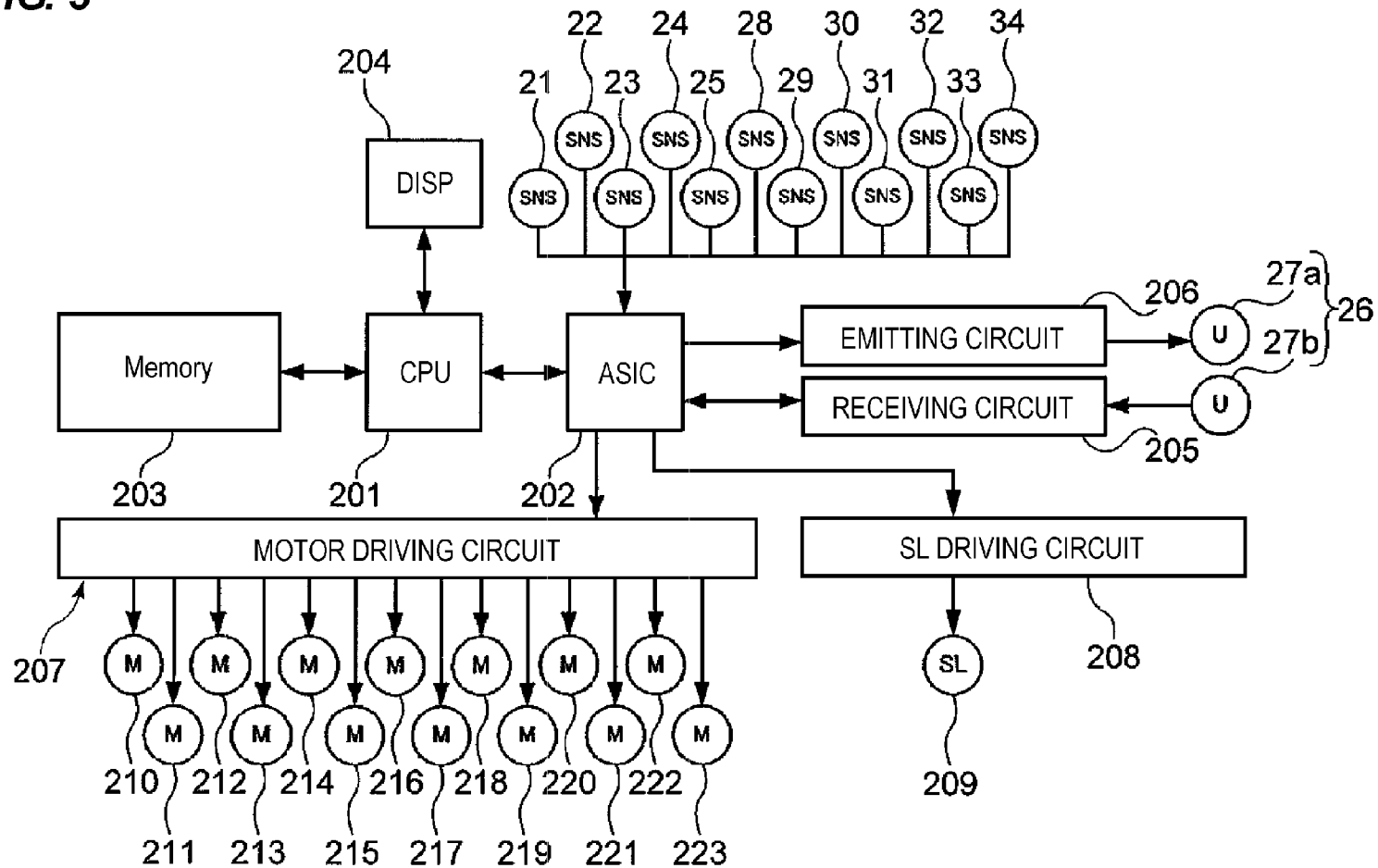
FIG. 3 is a view illustrating a circuit block configuration of a sheet feeding unit according to the present invention.

Next, the first embodiment according to the present invention will be described referring to FIG. 3. FIG. 3 is a block diagram illustrating the circuit block configuration of the sheet feeding unit 60A according to the first embodiment of the present invention.

As illustrated in FIG. 3, a CPU 201 which controls the sheet feeding unit 60A is connected with an ASIC 202, an operation portion (DISP) 204 and a storage portion (memory) 203. The CPU 201 forms a controlling portion which controls the multifeeding detection sensor 26 which is the multifeeding detecting portion to detect multifeeding of sheets at a plurality of detection points.

The CPU 201 refers to data stored in the storage portion 203. Then, the user sets a plurality of detection points of the multifeeding detection sensor (multifeeding detecting portion) 26 according to the sheet conveying direction size of the sheet inputted from the operation portion 204 (or sheet conveying velocity) and the detection timing of passing of the sheet in the first horizontal path sensor 25. That is, the CPU 201 sets a plurality of detection points based on size information of the sheet read from the storage portion 203 (or sheet conveying velocity) and the detection timing of passing of the sheet in the first horizontal path sensor 25 which is the passing detecting portion. A plurality of detection points are set across the front end and rear end of sheets moving in the sheet conveying direction. According to the present embodiment, the CPU 201 performs control to change intervals between a plurality of detection points for multifeeding detection in the multifeeding detection sensor 26. In addition, the sheet conveying velocity can be calculated based on, for example, the peripheral velocity of the pair of horizontal path rollers 10, or an arrival time from the lower vertical path sensor 23 to the first horizontal path sensor 25 or an arrival time from the upper vertical path sensor 24 to the first horizontal path sensor 25 where the distance between mutual detection points is uniform.

The ASIC 202 is dedicated to driving various loads of the sheet feeding unit 60A such as a stepping motor and solenoid. The operation portion 204 is configured as a setting portion which can receive data such as a sheet size, basis weight and surface nature as input. The storage portion 203 stores various data such as information of sheet conveying direction sizes of sheets stored in the storage units 2 and 3 which are the sheet accommodating portions.

The ASIC 202 is connected with the pull-out sensor 21 of the lower stage, the pull-out sensor 22 disposed inside the upper vertical path 36 of the upper stage side, the lower vertical path sensor 23 disposed inside the lower vertical path 35 of the lower stage side and the upper vertical path sensor 24 disposed inside the upper vertical path 36. The ASIC 202 monitors outputs of these sensors.

Further, the ASIC 202 is connected with the first horizontal path sensor 25 disposed inside the horizontal path 37, the second horizontal path sensor 28, the third horizontal path sensor 29 and fourth horizontal path sensor 30 and the buffer path sensor 31 disposed inside the buffer path 38. The ASIC 202 monitors outputs of these sensors. Further, the ASIC 202 is connected with the buffer discharge sensor 32 disposed inside the buffer path 38, the escape path sensor 33 disposed inside the escape path 39 and the escape discharge sensor 34, and the ASIC 202 monitors outputs of these sensors.

Further, the ASIC 202 is connected with the motor driving circuit 207. The ASIC 202 controls the driving circuit 208 of the solenoid 209 which switches the sheet conveying route to the escape path 39.

The motor driving circuit 207 respectively controls driving of belt motors 210 and 211 which respectively drive the attracting convey belts 4 and 5. The motor driving circuit 207 respectively control driving of the pull-out motors 212 and 213 which respectively drive the pairs of pull-out rollers 6 and 7, the lower vertical path motor 214 which drives the pair of lower vertical path rollers 8 and the upper vertical path motor 215 which drives the pair of upper vertical path rollers 9. The motor driving circuit 207 respectively controls driving of the horizontal path motors 216 to 219 which respectively drive the pairs of horizontal path rollers 10 to 13, and the buffer path motor 220 and buffer discharge motor 221 which respectively drive the pair of buffer path rollers 14 and the pair of buffer discharge rollers 15. The motor driving circuit 207 respectively controls driving of the escape path motor 222 which drives the pairs of escape path rollers 16, 17 and 18, and the escape discharge motor 223 which drives the pair of escape discharge rollers 19.

Although, according to the present embodiment, stepping motors are used in all of motors 210 to 213, motors of other schemes such as DC motors may be used as long as the specification of the apparatus is satisfied. Further, the ASIC 202 is connected with the emitting circuit 206 which generates and transmits an emission signal to the emitting element 27*a* of the multifeeding detection sensor 26, and the receiving circuit 205 which receives a signal from the receiving element 27*b* of the multifeeding detection sensor 26, and supports multifeeding detection control by the CPU 201.

In addition, although the sheet feeding unit 60A according to the present embodiment controls various loads of the sheet feeding unit 60A such as the motors and solenoid through the CPU 201 via the dedicated ASIC 202, it is naturally possible that the CPU 201 does not directly control the loads.

Figure 4:
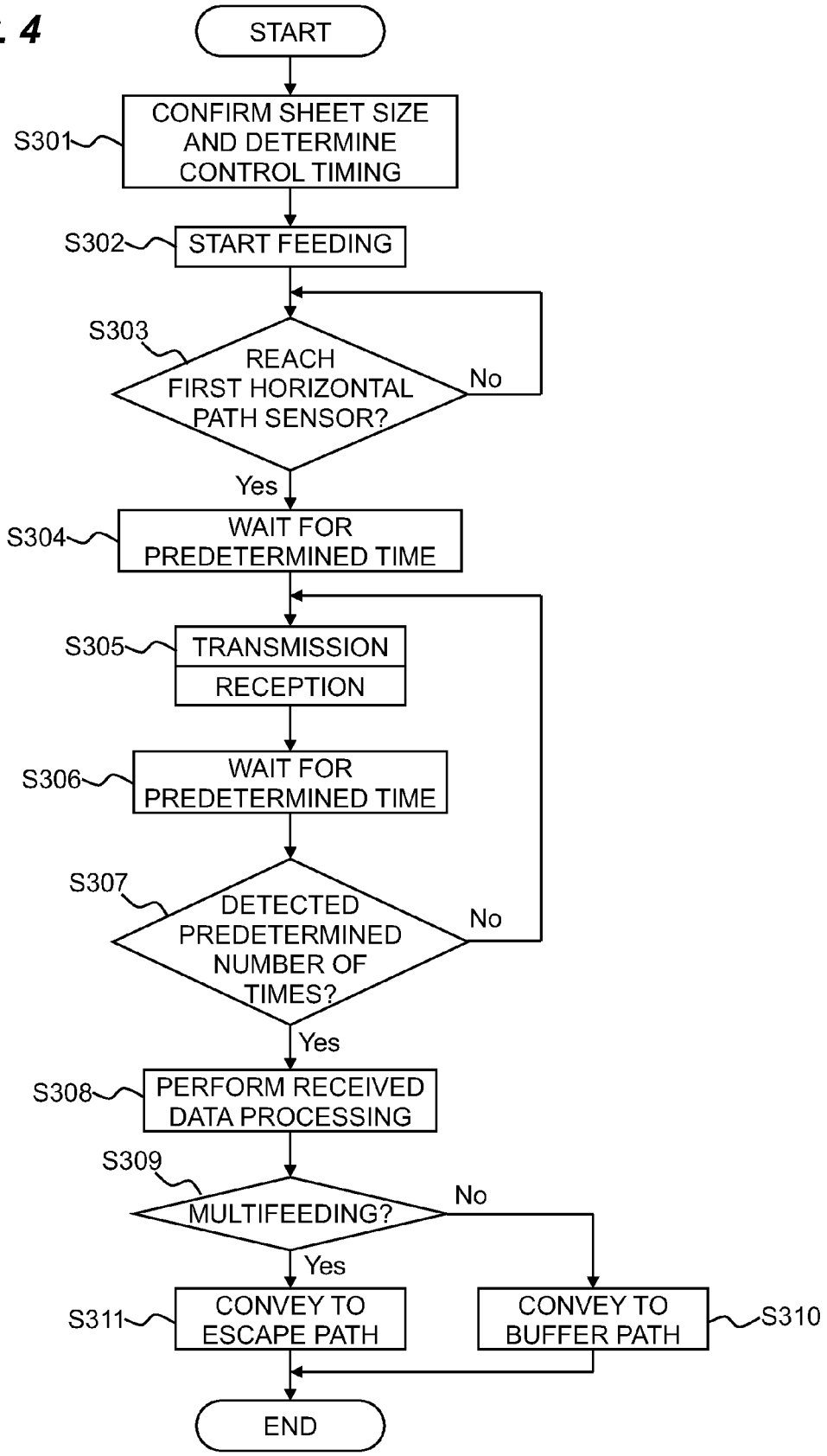
FIG. 4 is a flowchart illustrating the operation of a CPU of a sheet feeding unit according to the present invention.

FIG. 4 is a flowchart illustrating an operation of the CPU 201 according to the present embodiment. The control method of the CPU 201 will be described using FIG. 4. Here, assume that the flowchart starts from the state where the feed signal is received by the sheet feeding unit 60A.

First, the CPU 201 confirms the sheet sizes of sheets in the storage units 2 and 3 which are to be fed and which are set in advance by the user, and determines multifeeding detection timings of the multifeeding detection sensor 26 based on the size in the sheet conveying direction (step S301). Next, the CPU 201 feeds a sheet from an applicable storage unit according to the feed signal (S302), and monitors that the sheet front end arrives the first horizontal path sensor 25 arranged in upstream side of the multifeeding detection sensor 26 (S303).

After the sheet front end arrives the horizontal path first sensor 25, the sheet is made to wait for a predetermined time determined in step S301 based on the distance between the horizontal path first sensor 25 and the transmission point of the multifeeding detection sensor 26, the sheet multifeeding detection start position and the sheet conveying velocity (S304). Subsequently, the emitting element 27*a* of the multifeeding detection sensor 26 emits a signal and the receiving element 27*b* receives the signal (S305).

With the present embodiment, a plurality of transmissions are performed by means of emission and reception between the emitting element 27*a* and receiving element 27*b* of the multifeeding detection sensor 26 while a sheet is being conveyed, and therefore the sheet is made to wait for a predetermined time (S306) and whether or not multifeeding detection is performed a predetermined number of times set in advance is confirmed (S307). In addition, the waiting time in step S306 refers to the time it takes for the next multifeeding detection sensor transmission point on the sheet to come. This time is also determined based on the sheet conveying direction size of the sheet or the sheet conveying velocity in step S301.

When multifeeding detection is not performed a predetermined number of times in step S307, the CPU 201 returns to step S305 to detect multifeeding at the next multifeeding detection sensor transmission point. The CPU 201 proceeds to step S308 when multifeeding detection is performed a predetermined number of times. In step S308, received data based on multifeeding detection performed a predetermined number of times is processed. Whether or not sheets are multifed is decided in step S309. As a result, when it is decided in step S309 that sheets are not multifed, the sheet is conveyed to the buffer path 38 (S310), and is finally sent to the image forming unit 60B from the pair of buffer discharge rollers 15. By contrast with this, when it is decided in step S309 that sheets are multifed, the sheets are conveyed to the escape path 39 (S311) and are finally discharged to the escape tray 20 by the pair of escape discharge rollers 19.

Figure 7:
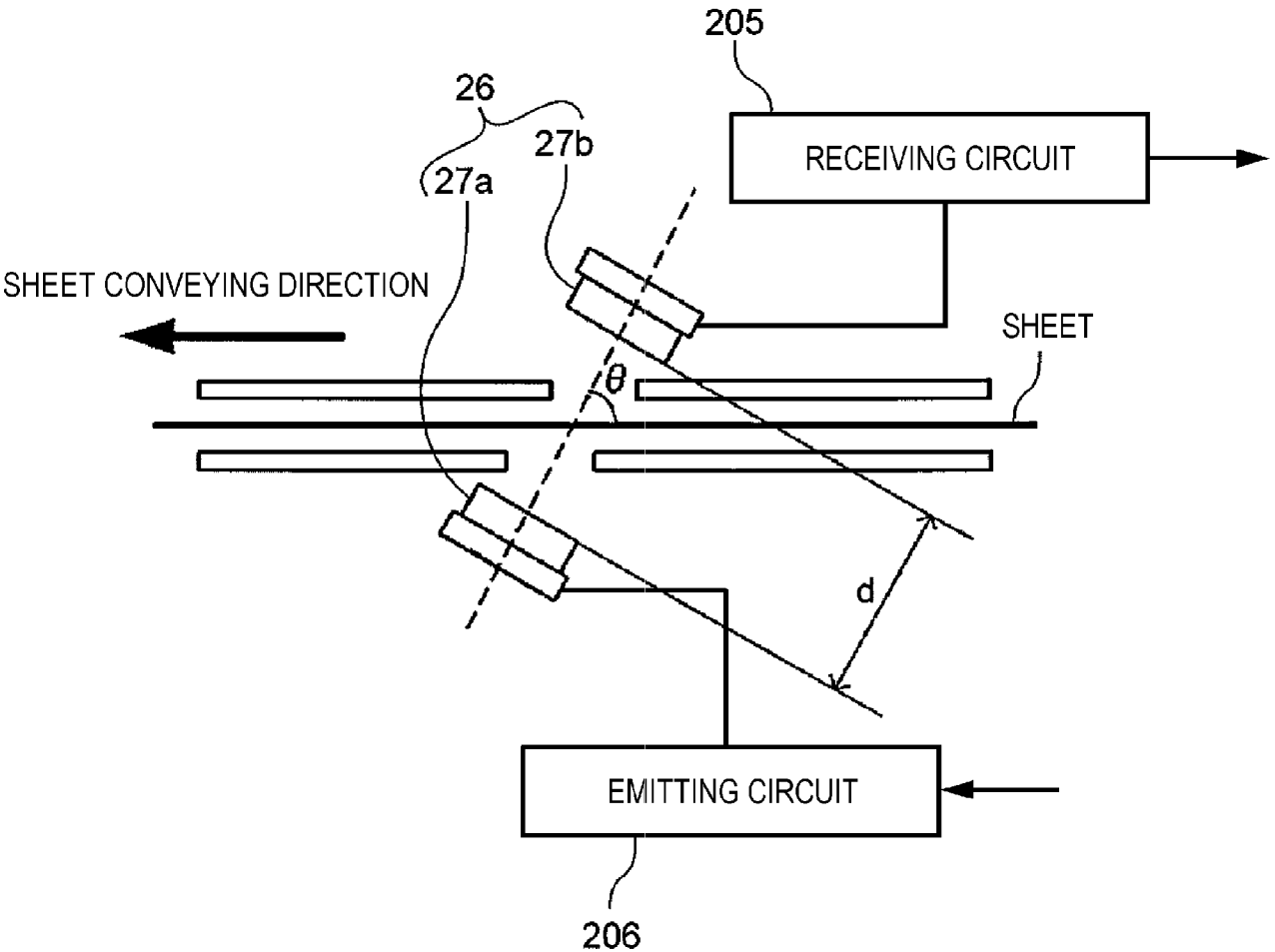
FIG. 7 is a diagram illustrating arrangement of a multifeeding detection sensor according to the first embodiment.

FIG. 7 is a view illustrating arrangement of the emitting element 27*a* and receiving element 27*b* of the multifeeding detection sensor 26. With the present embodiment, the multifeeding detection sensor 26 adopts an ultrasonic sensor. The emitting element 27*a* and receiving element 27*b* are arranged opposite each other on the lower side and upper side, respectively, across the sheet conveying path such that the emitting element 27*a* and receiving element 27*b* are spaced apart by the distance d, and the transmission axis between the emitting element 27*a* and receiving element 27*b* is inclined at an angle of θ with respect to the sheet conveying path. The emitting element 27*a* is connected with the emitting circuit 206 (also see FIG. 3) which generates an emission signal, and the receiving element 27*b* is connected with the receiving circuit 205 (also see FIG. 3) which receives a received signal.

Figure 8:
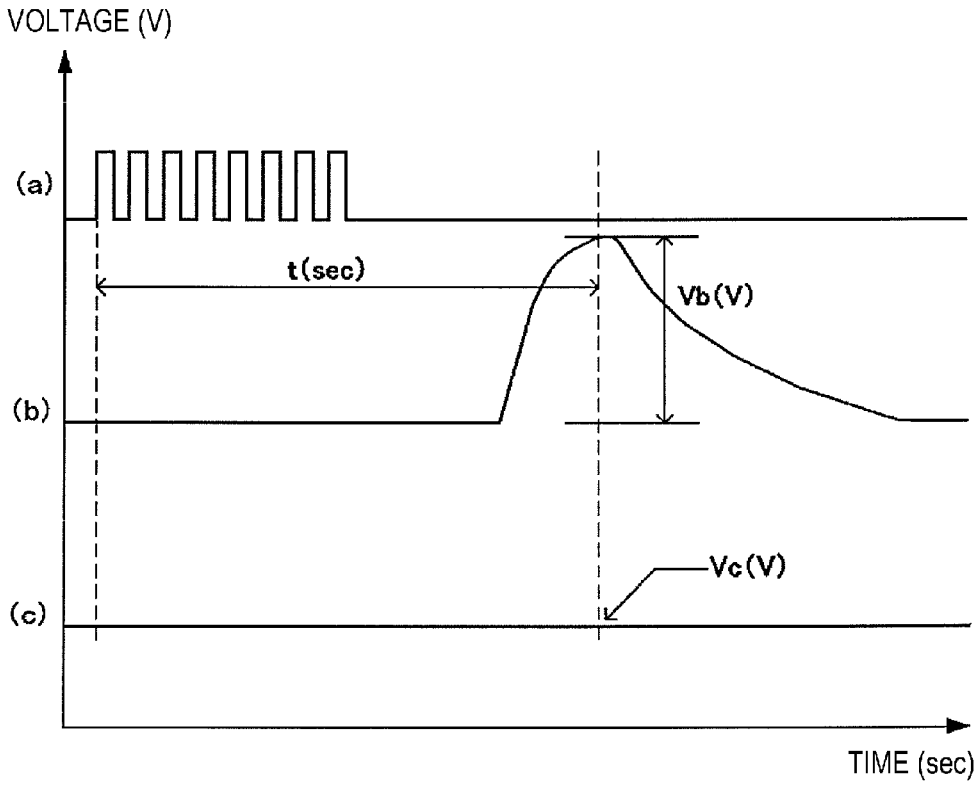
FIG. 8 is a view illustrating signals inputted to and outputted from an emitting circuit and receiving circuit of a multifeeding detection sensor according to the first embodiment.

FIG. 8 is a view illustrating signals inputted to and outputted from the emitting circuit 206 and receiving circuit 205 of the emitting element 27*a* and receiving element 27*b*. FIG. 8A illustrates a signal inputted to the emitting circuit 206, and pulses of a predetermined frequency are inputted a predetermined number of times (eight times in FIG. 8A). FIG. 8B illustrates a signal outputted from the receiving circuit 205 when one sheet is fed (not multifed), and FIG. 8C illustrates a signal outputted from the receiving circuit 205 when sheets are multifed.

While the output signal voltage of the receiving circuit 205 after a predetermined time t (sec) since pulses are inputted to the emitting circuit 206 is Vb (V) when one sheet is multifed in FIG. 8B, the voltage is Vc (V) which is almost 0 (V) when sheets are multifed in FIG. 8C. By taking a threshold between these voltages, it is possible to readily make a distinction as to whether one sheet is fed (not multifed) or sheets are multifed.

Figure 5A:
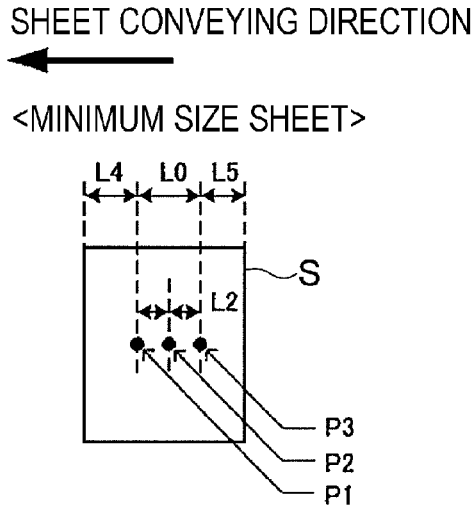
FIG. 5A PRIOR ART
FIGS. 5A to 5C are diagrams illustrating conventional multifeeding detection timings.
Figure 5B:
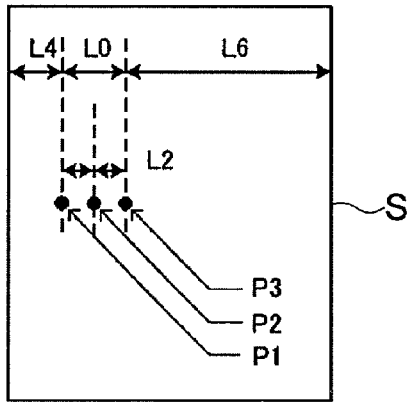
FIG. 5B PRIOR ART
Figure 5C:
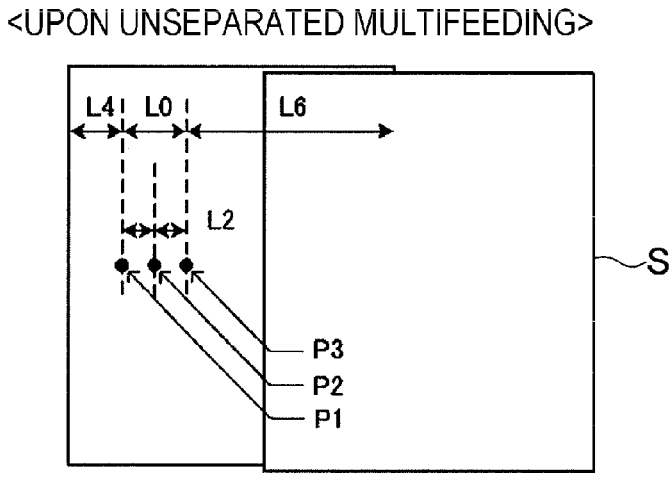
FIG. 5C PRIOR ART

FIGS. 5A to 5C are diagrams illustrating multifeeding detection timings in a comparative example. In the comparison example, as illustrated in FIGS. 5A and 5B, transmission points (three points P1 to P3 in FIGS. 5A to 5C) which are detection points of the multifeeding detection sensor are set in a detection area L0 between a non-detection area of the sheet front end L4 and a non-detection area L5 or L6 of the sheet rear end. Then, when a subsequent sheet overlaps a preceding sheet like one sheet without being misaligned, or when a subsequent sheet overlaps a preceding sheet in a state covering the detection area L0, it is possible to detect multifeeding of sheets. However, as illustrated in FIG. 5C, when a subsequent sheet is unseparated and multifed continuing to the rear end portion of a preceding sheet, outside the transmission point (non-detection area L6) of the multifeeding detection sensor, it is not possible to detect multifeeding of sheets.

Figure 6A:
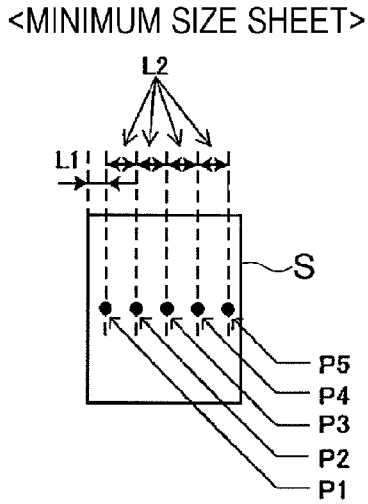
FIGS. 6A to 6C are diagrams illustrating multifeeding detection timings according to a first embodiment of the present invention.
Figure 6B:
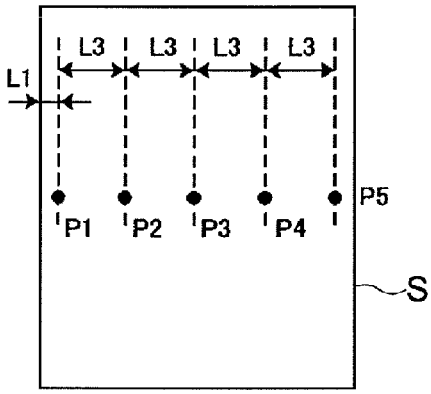
Figure 6C:
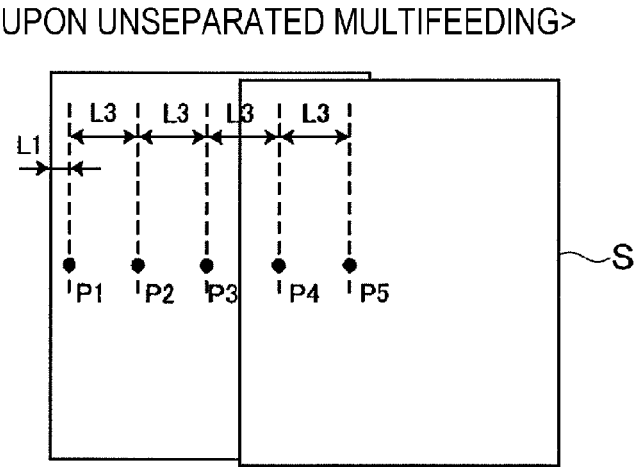

FIGS. 6A to 6C are diagrams illustrating multifeeding detection timings according to the present embodiment, and the distance between transmission points of the multifeeding detection sensor 26 is changed.

The CPU 201 according to the present embodiment sets the transmission point (P1) which is the first detection point of the multi-detection sensor, in the position spaced apart by L1 from the sheet front end according to the sheet size such that multifeeding can be detected within a number of times (five times in FIGS. 6A to 6C) set in advance in the sheet conveying direction. By making the distance between transmission points (P2, P3, P4 and P5) of the subsequent detection sensor L2 in case of the minimum size sheet in FIG. 6A and L3 wider than L2 in case of a large size sheet illustrated in FIG. 6B, the CPU 201 performs control such that multifeeding is detected in the entire area in the sheet conveying direction in both cases. In this case, even when unseparated multifeeding occurs as in FIG. 6C, it is possible to reliably decide unseparated multifeeding as multifeeding at transmission points of the multifeeding detection sensor 26.

As described above, according to the present embodiment, by setting a plurality of transmission points (detection points) P1 to P5 of the multifeeding detection sensor (multifeeding detecting portion) 26, it is possible to detect multifeeding across the front end and rear end of a preceding sheet in the sheet conveying direction. Therefore, it is also possible to detect as multifeeding the unseparated multifeeding that a subsequent sheet overlaps a preceding sheet. Accordingly, it is possible to provide a stable conveying state and realize a high-quality sheet feeding unit 60A and an image forming apparatus 60 having this sheet feeding unit 60A.

Further, the escape tray 20 which discharges multifed sheets, so that the present invention can discharge unseparated multifed sheets to the escape tray 20. Consequently, the apparatus is not stopped, so that the productivity does not fall. In addition, five transmission points (detection points) P1 to P5 are set according to the present embodiment, which is not restrictive, and the number of transmission points may be set to four or less or six or more.

Second Embodiment

Next, a second embodiment according to the present invention will be described in detail using FIGS. 11A to 11C. Since the circuit configuration of the sheet feeding unit 60A (see FIGS. 1 and 2) and the controlling method of the CPU according to the present embodiment are the same as those in the first embodiment, the circuit block diagram (FIG. 3) and the flowchart (FIG. 4) of the first embodiment will be used instead. Further, the same portions will be given the same reference numerals to omit their descriptions.

Figure 11A:
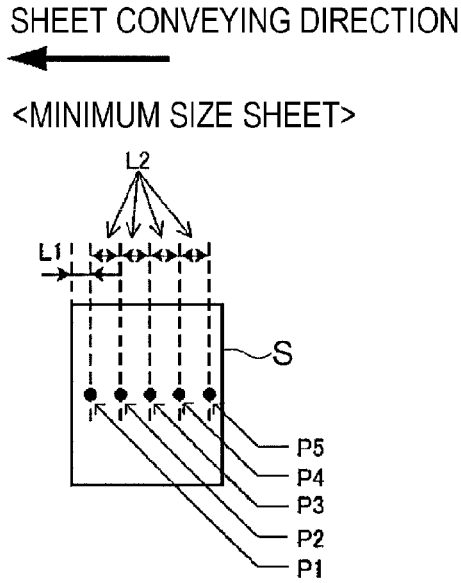
FIGS. 11A to 11C are diagrams illustrating multifeeding detection timings according to a second embodiment of the present invention.
Figure 11B:
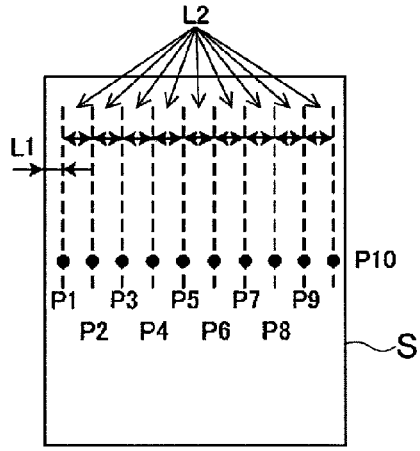
Figure 11C:
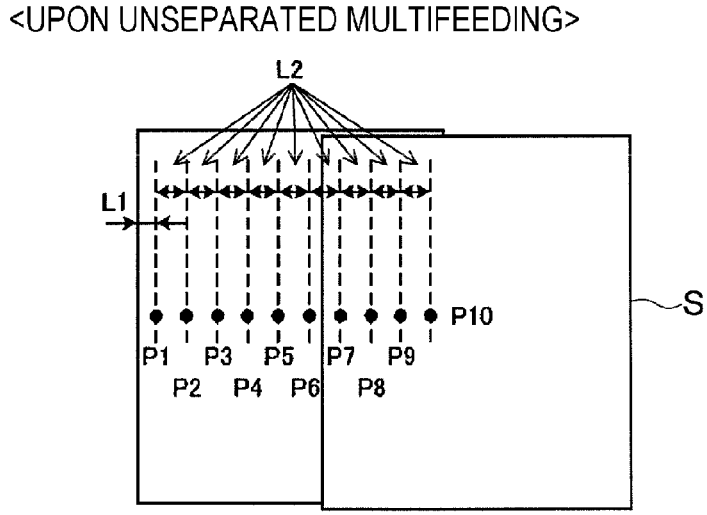

FIGS. 11A to 11C are diagrams illustrating multifeeding detection timings according to the embodiment, with the number of transmission points of the multifeeding detection sensor 26 being changed.

According to the present embodiment, the CPU 201, which is the controlling portion, performs control to change the number of transmission points or a plurality of detection points for multifeeding detection. That is, regardless of a sheet size, the first transmission point (P1) of the multifeeding detection sensor 26 is set in a position spaced apart by L1 from the sheet front end, and the distance (interval) between subsequent transmission points of the multifeeding detection sensor 26 is made the same as L2 across the entire sheet conveying direction area to detect multifeeding.

The CPU 201 according to the embodiment refers to data stored in the storage portion 203. Further, a plurality of transmission points of the multifeeding detection sensor 26 are set according to the sheet conveying direction size of the sheet inputted from the operation portion 204 (or sheet conveying velocity), the detection timing of passing of the sheet in the horizontal path first sensor 25 and the control time of multifeeding detection. That is, in case of the minimum size sheet of FIG. 11A, the CPU 201 sets five transmission points (P1 to P5) having the same distance L2 across the front end and rear end of the sheet. Further, in case of the large size sheet of FIG. 11B, ten transmission points P1 to P10 having the same distance L2 are set across the front end and rear end of the sheet. Accordingly, even when unseparated multifeeding occurs as in FIG. 11C, it is possible to reliably decide unseparated multifeeding as multifeeding at transmission points of the multifeeding detection sensor 26.

As described above, according to the second embodiment, the number of transmission points can be changed according to the sheet conveying direction size of the sheet moving on the horizontal path 37 (or sheet conveying velocity), the detection timing of the first horizontal path sensor 25 and the control time of multifeeding detection. This enables detection of multifeeding in the entire area of a preceding sheet in the sheet conveying direction, and determination of the unseparated multifeeding where the subsequent sheet follows overlapping the preceding sheet.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-055679, filed Mar. 12, 2010, which is hereby incorporated by reference herein in its entirety.

What is claimed is:

1. A sheet feeding apparatus comprising:

a sheet accommodating portion configured to accommodate one or more sheets;

a separation portion configured to separate a sheet one by one sent out from the sheet accommodating portion in a sheet conveying direction;

a pair of sheet conveying rollers disposed at a downstream of the separation portion, wherein the pair of sheet conveying rollers is configured to convey, in the sheet conveying direction, the sheet separated by the separation portion;

a storage portion which stores information that includes a sheet conveying direction size of a sheet accommodated in the sheet accommodating portion;

a sheet conveying path configured to guide a sheet separated by the separation portion;

a passing detecting portion disposed on the sheet conveying path downstream of the pair of sheet conveying rollers, wherein the passing detecting portion is configured to detect passing of a sheet sent out from the sheet accommodating portion and guided on the sheet conveying path;

a multifeeding detecting portion configured to detect whether a target sheet that has passed the passing detecting portion is one sheet or multifed sheets by using a plurality of detection points set to the target sheet; and a controlling portion configured to control the multifeeding detecting portion to cause the multifeeding detecting portion to detect, at each of the plurality of detection points, whether the target sheet is one sheet or multifed sheets, wherein the controlling portion further is configured to:

set, in advance, a number of detection points as the plurality of detection points, change a distance between the plurality of detection points according to a change in the size of the sheet without changing the number of detection points according to a change in the size of the sheet, and set the plurality of detection points along an entire length of the target sheet, from a leading edge of the target sheet to a trailing edge of the target sheet in the sheet conveying direction, based on the size information read from the storage portion and a timing of detecting passing of the sheet in the passing detecting portion, such that multifed sheets can be detected in a case where a preceding sheet and a subsequent sheet are partially overlapped as an unseparated multifeeding.

2. The sheet feeding apparatus according to claim 1, wherein the controlling portion performs control to change an interval between the plurality of detection points for the multifeeding detection.

3. The sheet feeding apparatus according to claim 1, wherein the controlling portion controls the multifeeding detecting portion to change a number of the plurality of detection points for the multifeeding detection.

4. An image forming apparatus comprising:

an image forming portion; and a sheet feeding apparatus having:

a sheet accommodating portion configured to accommodate one or more sheets, a separation portion configured to separate a sheet one by one sent out from the sheet accommodating portion in a sheet conveying direction, a pair of sheet conveying rollers disposed at a downstream of the separation portion, wherein the pair of sheet conveying rollers is configured to convey, in the sheet conveying direction, the sheet separated by the separation portion, a storage portion which stores information that includes a sheet conveying direction size of a sheet accommodated in the sheet accommodating portion, a sheet conveying path configured to guide a sheet separated by the separation portion, a passing detecting portion disposed on the sheet conveying path downstream of the pair of sheet conveying rollers, wherein the passing detecting portion is configured to detect passing of a sheet sent out from the sheet accommodating portion and guided on the sheet conveying path, a multifeeding detecting portion configured to detect whether a target sheet that has passed the passing detecting portion is one sheet or multifed sheets by using a plurality of detection points set to the target sheet, and a controlling portion configured to control the multifeeding detecting portion to cause the multifeeding detecting portion to detect, at each of the plurality of detection points, whether the target sheet is one sheet or multifed sheets, wherein the controlling portion further is configured to:

set, in advance, a number of detection points as the plurality of detection points, change a distance between the plurality of detection points according to a change in the size of the sheet without changing the number of detection points according to a change in the size of the sheet, and set the plurality of detection points along an entire length of the target sheet, from a leading edge of the target sheet to a trailing edge of the target sheet in the sheet conveying direction, based on the size information read from the storage portion and a timing of detecting passing of the sheet in the passing detecting portion, such that multifed sheets can be detected in a case where a preceding sheet and a subsequent sheet are partially overlapped as an unseparated multifeeding.

5. The image forming apparatus according to claim 4, wherein the controlling portion performs control to change an interval between the plurality of detection points for the multifeeding detection.

6. The image forming apparatus according to claim 4, wherein the controlling portion controls the multifeeding detecting portion to change a number of the plurality of detection points for the multifeeding detection.

7. A method for a sheet feeding apparatus, the method comprising:

accommodating, in a sheet accommodating portion, one or more sheets;

separating, using a separation portion, a sheet one by one sent out from the sheet accommodating portion in a sheet conveying direction;

conveying, in the sheet conveying direction and using a pair of sheet conveying rollers disposed at a downstream of the separation portion, the sheet separated by the separation portion;

storing, in a storage portion, information that includes a sheet conveying direction size of a sheet accommodated in the sheet accommodating portion;

guiding a sheet separated by the separation portion along a sheet conveying path;

detecting, using a passing detecting portion disposed on the sheet conveying path downstream of the pair of sheet conveying rollers, passing of a sheet sent out from the sheet accommodating portion and guided on the sheet conveying path;

detecting, using a multifeeding detecting portion, whether a target sheet that has passed the passing detecting portion is one sheet or multifed sheets by using a plurality of detection points set to the target sheet; and controlling, using a controlling portion, the multifeeding detecting portion to cause the multifeeding detecting portion to detect, at each of the plurality of detection points, whether the target sheet is one sheet or multifed sheets, wherein controlling further includes:

setting, in advance, a number of detection points as the plurality of detection points, changing a distance between the plurality of detection points according to a change in the size of the sheet without changing the number of detection points according to a change in the size of the sheet, and setting the plurality of detection points along an entire length of the target sheet, from a leading edge of the target sheet to a trailing edge of the target sheet in the sheet conveying direction, based on the size information read from the storage portion and a timing of detecting passing of the sheet in the passing detecting portion, such that multifed sheets can be detected in a case where a preceding sheet and a subsequent sheet are partially overlapped as an unseparated multifeeding.

* * * * *